United States Patent [19]

Bauer

[11] 4,072,821

[45] Feb. 7, 1978

[54] MICROPHONE SYSTEM FOR PRODUCING SIGNALS FOR QUADRAPHONIC REPRODUCTION

[75] Inventor: Benjamin B. Bauer, Stamford, Conn.

[73] Assignee: CBS Inc., New York, N.Y.

[21] Appl. No.: 685,065

[22] Filed: May 10, 1976

[51] Int. Cl.[2] ..... H04R 5/00

[52] U.S. Cl. ..... 179/1 GQ; 179/100.4 ST

[58] Field of Search ..... 179/1 GQ, 1 DM, 100.4 ST, 179/100.1 TD, 15 BT

[56] References Cited

U.S. PATENT DOCUMENTS

| | | | |
|---|---|---|---|
| 3,856,992 | 12/1974 | Cooper | 179/1 GQ |
| 3,890,466 | 6/1975 | Bauer | 179/1 GQ |
| 3,940,560 | 2/1976 | Condamines | 179/1 GQ |

*Primary Examiner*—Douglas W. Olms

*Attorney, Agent, or Firm*—Spencer E. Olson

[57] ABSTRACT

A system including a compact array of special purpose microphones and an encoder, especially suited for use with surround-sound sources, for producing two composite output signals equivalent to those required by the "SQ" quadraphonic system to establish the directional position of the sources. The output signals from the system can be used directly to record an "SQ"-matrixed tape, or they can be applied to a disc cutter to produce an "SQ" record, or they can be broadcast for reception by FM receivers equipped with an "SQ" decoder, resulting in the generation of outputs in the quadraphonic "SQ" listening system which reproduce the directional characteristic of the original sound sources. Thus, the system performs the function of a conventional multimicrophone and encoder system for "SQ" recording or broadcasting.

10 Claims, 20 Drawing Figures

$E = \frac{1}{2} + \frac{1}{2} \cos\theta$ $E = \frac{1}{4} + \frac{3}{4} \cos\theta$ $E = 0.295 + 0.705 \cos\theta$

MICROPHONE SYSTEM FOR PRODUCING SIGNALS FOR QUADRAPHONIC REPRODUCTION

BACKGROUND OF THE INVENTION

1. Field of the Invention

The present invention relates to quadraphonic sound systems, and more particularly to a system for producing from surround-sound sources two composite signals which when decoded by a suitable decoder reproduce the directional characteristic of the original sound sources.

2. Prior Art

In the CBS Inc. "SQ" system of quadraphonic broadcasting and recording, the various directional sources are picked up with microphones which generally are close to the sources so as to largely contain signals of the individual sources. The outputs of the microphones are connected to an encoder of the type described in Bauer Pat. No. 3,890,466 comprising adders, subtractors and phase shifters, wherein the signals from the directional sources are mixed to produce two composite output signals, LT and RT (Left Total and Right Total), which may be recorded on a two-track medium or broadcast over an FM-stereo transmitter. There are occasions, however, where the sound pickup cannot be carried out conveniently with microphones which are close to the sources. For example, it may be desired to place a group of actors in a semicircle or partial circle in order to perform a dramatic program, and to have them at times walk around. It would be difficult to pick up their movements with ordinary microphones and to encode them properly through a conventional SQ encoder to obtain an appropriate feeling of motion in the decoded signal. As another example, if one desired to broadcast the sounds of an orchestra located in a semicircular or similar arrangement, it would be advantageous to avoid the possible adverse reaction from the audience which might result from the sight of many microphones on the stage.

The basic idea of combining a microphone array with signal processing networks to produce composite signals containing signal information corresponding to a multiplicity of remote acoustical sources suitable for decoding for stereophonic or quadraphonic reproduction is known from British Pat. No. 394,325 of Alan D. Blumlein. The system described in this early patent (1931) utilizes two pressure microphones with associated networks and two velocity microphones arranged at 90 degrees relative to each other to produce a stereo image with two loudspeakers. This patent also combines two velocity microphones in an angular and axial arrangement with suitable networks to produce a quadraphonic image around a motion picture screen.

A modern-day extension of this basic concept is embodied in a system described on pages 222–224 of the Jan. 29, 1976 issue of New Scientist consisting of a microphone using four conventional "cardioid" capsules arranged in a regular tetrahedral array. Each cardioid capsule picks up sound from its front only, and the four capsules point respectively left-back-down, left-front-up, right-front-down and right-back-up. The four "raw" output signals from these capsules are electrically added, subtracted and frequency-equalized, to produce four electrical signals which correspond respectively to the pressure of a sound wave arriving at the microphone and the three orthogonal components of air velocity due to its wave motion. The four derived signals contain height information, but because no one is yet commercially interested in reproducing it, the height information is redundant; thus, one of the four signals is left unused, and the remaining three signals, containing all the azimuth information received by the microphone array are fed to three channels.

The article suggests that for transmission to the domestic consumer, as by disc or tape recording or broadcast, the three (or four) signals would probably be encoded into a conventional pair of stereo signals, or into a stereo pair plus a single extra channel. It is also suggested that various three channel-into-two channel encoding approaches are possible using both phase and amplitude differences between the signals, to produce two channels of encoded sound which may be decoded by a complementary method, generally involving use of sum and difference techniques to recreate the omnidirectional and azimuth channels. However, the article does not described how the encoding is to be accomplished, and specifically states that the hardware cannot be modified to process surround-sound material encoded in the "SQ" format.

SUMMARY OF THE INVENTION

It is the primary object of the present invention to provide a system utilizing a microphone array and an encoding circuit for producing two composite signals equivalent to those required by the "SQ" quadraphonic system to establish the directional position of surround-sound sources.

A surround-sound detection and encoding apparatus in accordance with one embodiment of the invention comprises an array of four bidirectional microphones and a single omnidirectional microphone supported on a common vertical axis, the output terminals of each of which are connected to a respective adjustable gain amplifier. The four bidirectional microphones have different azimuth orientations so selected that when their respective maximum output voltages (produced by a progressive sound wave of unity pressure $p$) are combined with the voltages produced by the omnidirectional microphone, four polar patterns characterized by the normallized limacon equation $E = k + (1-k) \cos \theta$, where $k$ is the relative contribution of the pressure microphone and $(1-k)$ that of each of the bidirectional microphones, and having different orientation are formed, the four resultant signals being selectively phase-shifted and combined to produce two composite output signals utilized in the "SQ" quadraphonic sound system. In the embodiment to be described, $k$ has a value of 0.295 and $(1-k)$ the value 0.705, but there may be departures from these exact values without detracting materially from the performance of the system, and other values may be more appropriate for particular system requirements.

In another embodiment of the invention, four relatively unidirectional microphones having limacon directional patterns are supported in close proximity with respect to each other with their directivity axes suitably displaced with respect to each other, and the output voltages from the four microphones are matrixed by suitable addition, subtraction and amplification to produce four output signals having suitable polar patterns such that in combination with selective phase-shifting circuits two composite signals having the characteristics of the composite signal required by the "SQ" quadraphonic system to establish the directional position of surround-sound sources are formed.

DESCRIPTION OF TECHNOLOGY UTILIZED IN THE INVENTION

Figure 1:
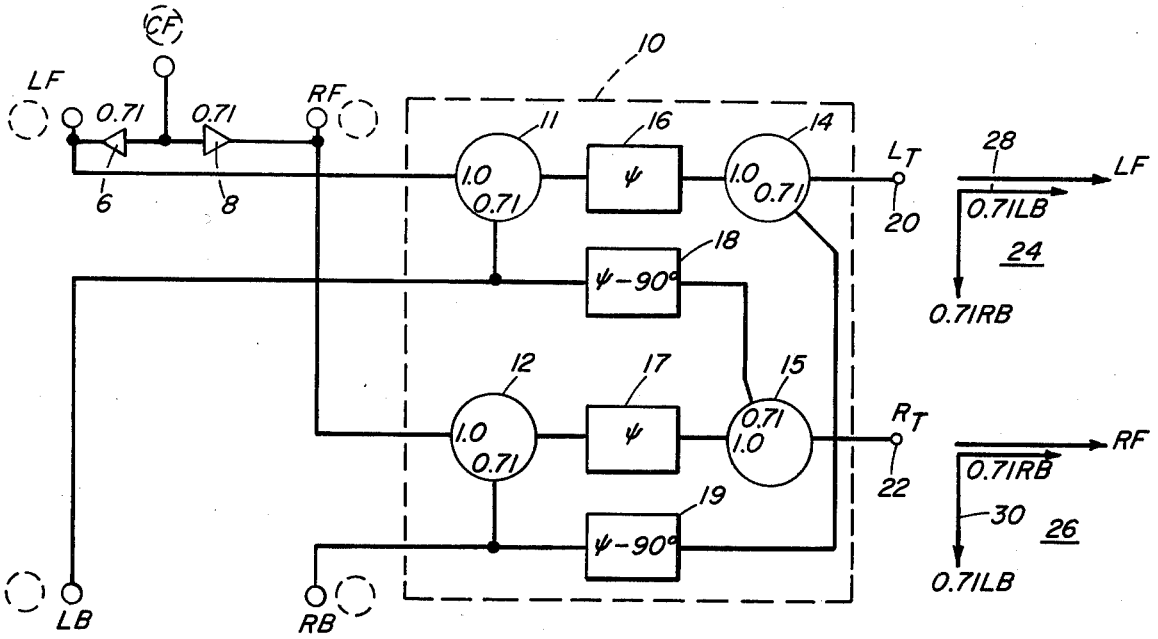
FIG. 1 is a block diagram of a known "SQ" encoder.

Before proceeding to a description of the system according to the invention, the nature of the composite signals utilized in the "SQ" quadraphonic system will be briefly described to provide a better understanding of the object and function of the invention. FIG. 1 is a block diagram of the aforementioned known encoding system in which four microphones, LF, RF, LB and RB are arranged to pick up the directional sound sources correspondingly named and depicted by dash-line circles, namely, LEFT FRONT, RIGHT FRONT, LEFT BACK AND RIGHT BACK, which are encoded into two composite signals for producing a quadraphonic record or for broadcast. It should be noted that a center front source, CF, also may be picked up by providing a separate microphone whose output is applied equally to the inputs LF and RF by means of a pair of amplifiers 6 and 8 so that each will contribute a 0.71 fraction of the output produced by the microphone, resulting in equal in-phase signals being applied to the lines leading from LF and RF. The four signals LF, LB, RF and RB, as well as those corresponding to CF are applied to an encoder 10 in which they are combined with the aid of adding junctions 11, 12 and 14, 15 and phase-shift networks 16, 17 and 18, 19 to produce at the terminals 20 and 22 two output signals LT and RT, all as more fully described in the aforementioned U.S. Pat. No. 3,890,466. The phase or groups 24 and 26 illustrate the relative amplitudes and positions of the signal phasors LF, RF, LB and RB in the composite signals LT and RT, respectively. Intermediate signals from other directional sources can be applied to corresponding pairs of terminals of the encoder as has been done with CF.

Figure 2:
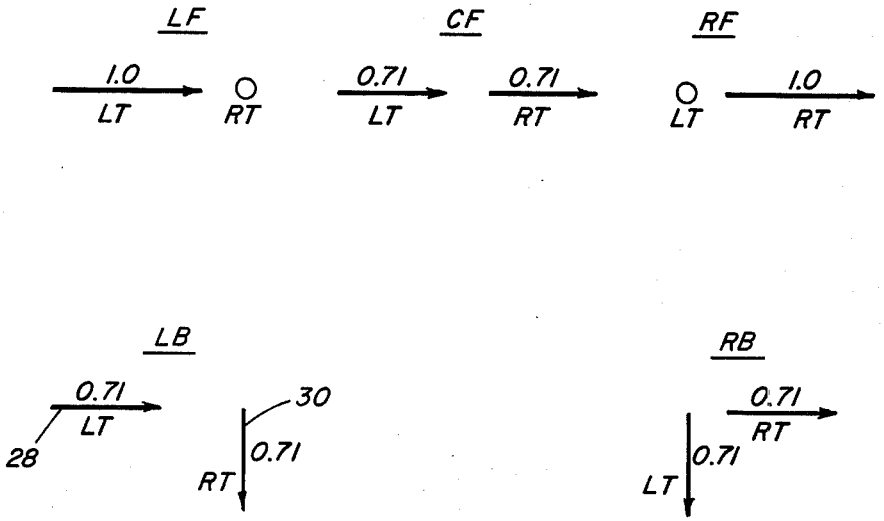
FIG. 2 shows a multiplicity of phasors, used in explaining the operation of the invention.

The purpose of the microphone system according to the invention being to produce composite signals equivalent to those produced in the system shown in FIG. 1, for comparative purposes the phasors of LT and RT corresponding to the specific directional signal positions at LB, LF, CF, RF and RB are shown in FIG. 2. The procedure is to assume that one signal exists at a time and to determine the resulting phasors from the respective phasor groups 24 and 26. It is seen, for example, that in the instance of there being an LB signal only, the LT signal consists of a single signal phasor 28, and the RT signal consists of a single phasor 30. These are now transferred to the pair of phasors in FIG. 2 identified as LB, LF, CF, etc. The center-front phasor group, CF in FIG. 2, is obtained by assuming that the signal CF is applied to each of LF and RF with an intensity 0.71, as shown in FIG. 1, and so on for the other signals.

Figure 3:
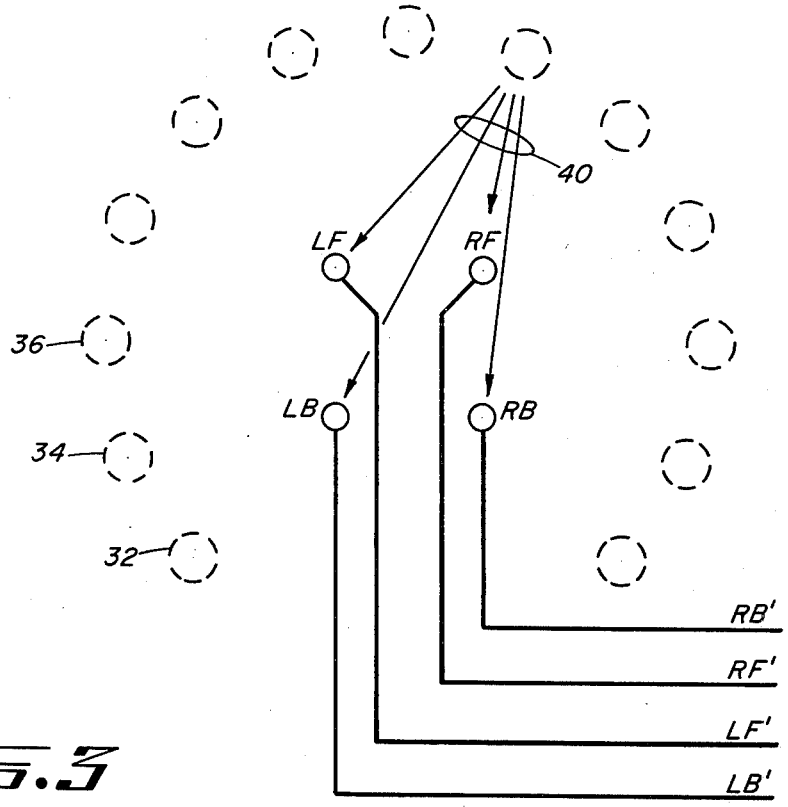
FIG. 3 diagrammatically illustrates a prior art system for sensing and encoding surround-sound sources.
Figure 4:
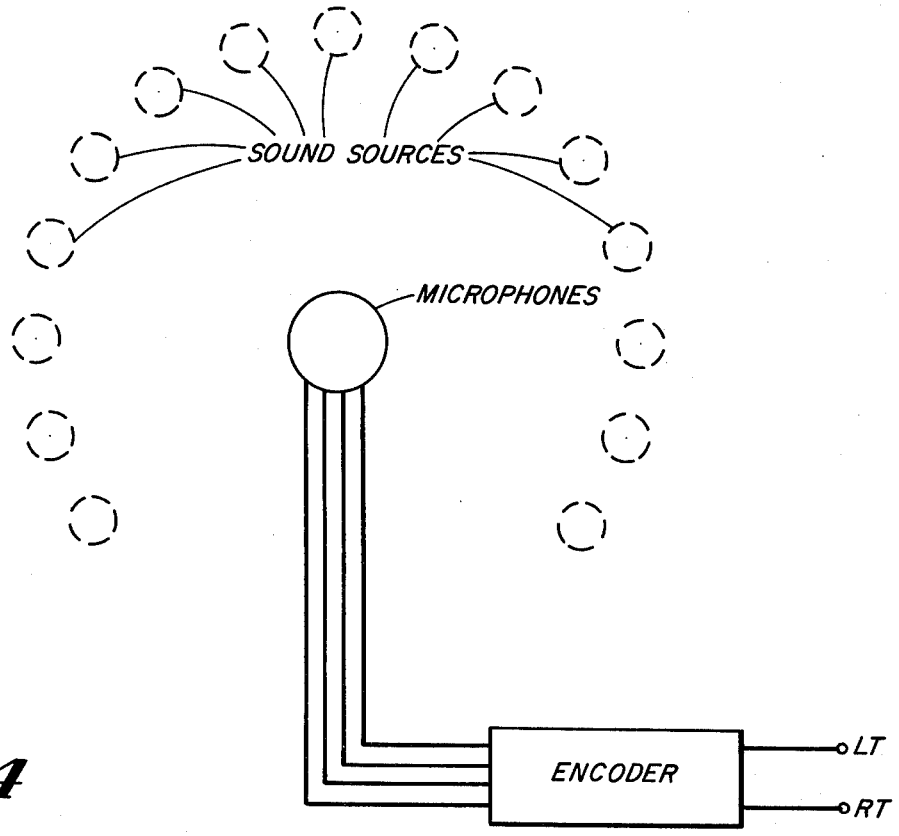
FIG. 4 diagrammatically illustrates the system of the present invention in a surround-sound environment.

Let it now be assumed that one desires to pick up and reproduce properly the sound of sources 32, 34, 36, etc. placed in a circular arrangement and at some distance from the four microphones LF, RF, LB and RB, as shown in FIG. 3. It is seen that each of the microphones will receive the sound of each of the sources, as depicted by the arrows 40, and that the signals produced by these sources in each microphone will be in different phase relationships as a result of the different distances between the sources and the microphones. The resultant composite signals, LF′, RF′, LB′ and RB′ produced by the microphones would be too confused to allow a correct encoding of the direction of each particular source if the conventional encoder of FIG. 1 is used. However, if the microphones are endowed with appropriate directional characteristics and placed in close proximity to each other as shown in FIG. 4, such that the signals produced by the individual microphones are substantially in-phase, then it would be possible to obtain outputs from the various microphones which differ from each other principally in intensity, and not in phase, and these outputs could then be combined in a suitable encoder according to the invention to produce composite output signals which are appropriately coded to produce an "SQ" quadraphonic record or for broadcast.

Microphones exhibiting a wide variety of directional characteristics are known in the art, two of which, namely, an "omnidirectional" microphone and a "bidirectional" microphone, are utilized in a spatial arrangement to achieve the purposes of the present invention. Although the construction and operation both of these types of microphones are generally known, they will here be described to clarify their applicability to the present invention.

Figure 5:
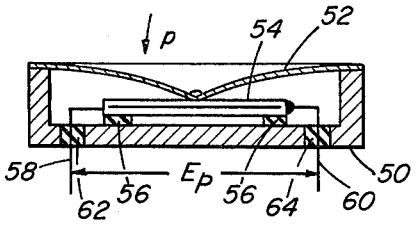
FIG. 5 and 6 are elevation cross-sectional and plan views, respectively, of a known omnidirectional microphone cartridge.
Figure 6:
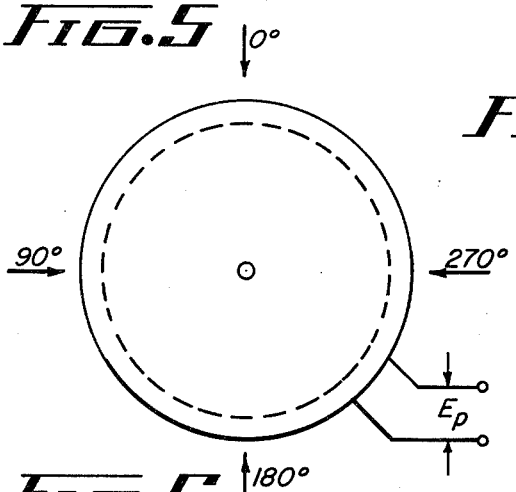
Figure 7:
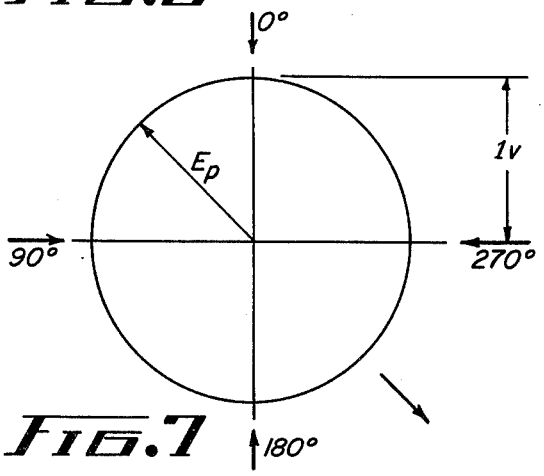
FIG. 7 shows the polar sensitivity pattern of an omnidirectional microphone.

FIG. 5 is a cross-sectional view of the cartridge of an omnidirectional microphone which comprises a small, circular box or enclosure 50 to which a diaphragm 52 is secured, the latter being in contact with a piezoelectric element 54 which, in turn, is supported on insulated supports 56. The electrodes 58 and 60 of the piezoelectric element are coupled out of the case through insulators 62 and 64. Acoustical pressure (p) applied to the diaphragm causes a vibratory deformation of the piezoelectric element 54, and results in a generation of an alternating voltage (Ep) across the microphone terminals. The microphone is shown in plan view in FIG. 6, and because of its relatively symmetrical construction it is readily seen that sounds arriving from any horizontal azimuth around the vertical microphone axis (0°, 90°, 180° and 270° azimuth are shown) will result in an invarying Ep. This is shown further in FIG. 7 which is the circular "polar sensitivity pattern" of the microphone, which has a constant radius Ep.

Figure 9:
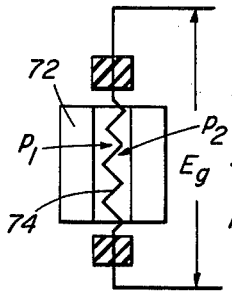
FIG. 9 is a cross-sectional view taken along line 9—9 of FIG. 8.
Figure 8:
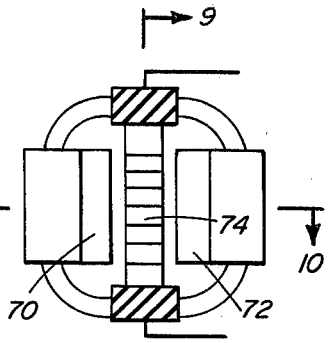
FIG. 8 is an elevational view of a bidirectional or "gradient" ribbon microphone.
Figure 10:
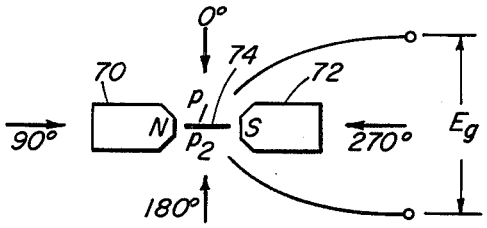
FIG. 10 is a cross-sectional view taken along line 10—10 of FIG. 8.
Figure 11:
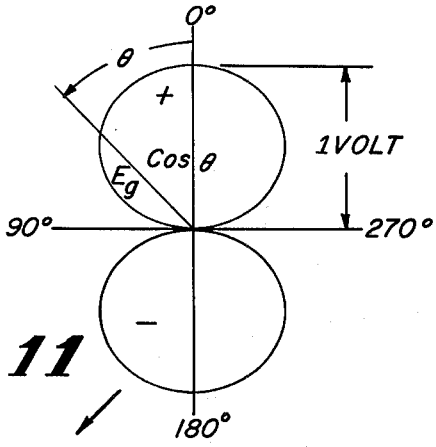
FIG. 11 shows the polar sensitivity pattern of the microphone of FIG. 8.

FIG. 8 shows in elevation and FIG. 9 in cross-section along the line 9—9 in FIG. 8, a "bidirectional" or "gradient" ribbon microphone. This microphone consists of two magnetized pole pieces 70 and 72, in between which is suspended for free motion a thin, corrugated, aluminum ribbon 74, the output voltage being generated in the ribbon as a result of vibrations induced by the pressure difference $p_1$–$p_2$ produced at its sides by a sound wave. The microphone is shown in horizontal cross-section in FIG. 10, and it is seen that signals from 0° azimuth have to travel around the structure of the microphone to produce unequal pressures $p_1$ and $p_2$ at the front and the back of the ribbon, respectively, resulting in the generation of an output voltage, while signals arriving from 90° or 270° produce equal and opposite pressures at the sides of the ribbon; thus, no pressure differential exists and the microphone output is zero. Signals from 180° will be as effective as those from 0°, except that inasmuch as the sound first to strike the surface arrives from the opposite direction from that at 0°, the polarity of the output voltage, $E_g$, will be reversed from that which occurs for 0° direction. It is known that the amplitude of the voltage $E_g$ as a function of azimuth varies with the cosine of the angle of incidence, resulting in a polar sensitivity pattern which follows the cosine law, $E_g = \cos\theta$, in which it is assumed that $E_g$ maximum is normalized to unity, as shown in FIG. 11. It should be remembered that voltages generated at angles greater than 90° and smaller than 270° are in phase opposition to those generated for identical signals arriving from angles greater than 270° and smaller than 90°, this being signified by the + and − signs in FIG. 11.

Figure 12:
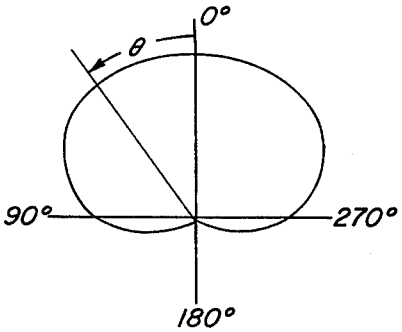
FIGS. 12, 13 and 13a illustrate three polar sensitivity patterns in the limacon family of patterns.
Figure 13:
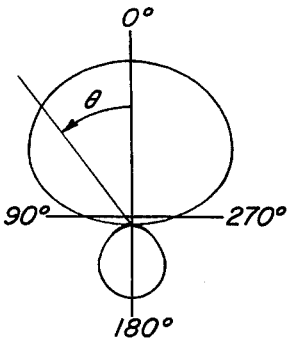
Figure 13A:
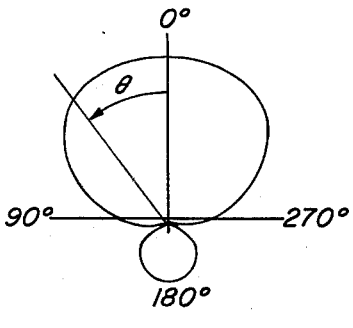

There is a third, very important class of microphone directivity which can be obtained by combining a bidirectional microphone with an omnidirectional microphone. For example, if one combines the omnidirectional microphone in which $Ep = 1$ with the bidirectional microphone in which $E = \cos\theta$, the resultant sum has a directional polar pattern of so-called "cardioid shape", $E = 1 + \cos\theta$; or if normalized, $E = \frac{1}{2} + \frac{1}{2}\cos\theta$, as shown in FIG. 12. Another important member of the same family is $E = \frac{1}{4} + \frac{3}{4}\cos\theta$, shown in FIG. 13. An additional family member, especially useful in connection with the present invention, is $E = 0.295 + 0.705\cos\theta$, shown in FIG. 13a, although other coefficient values may be used to implement the purposes of the invention. This family of curves is known as the "limacon" family of patterns and have the general equation $E = k + (1-k)\cos\theta$, where the parameter k may vary from 0 to 1. It will be noted that when $k = 1$, the pattern is circular as in FIG. 7, and when $k = 0$, the pattern is bidirectional as in FIG. 11.

DETAILED DESCRIPTION OF THE INVENTION

Figure 14:
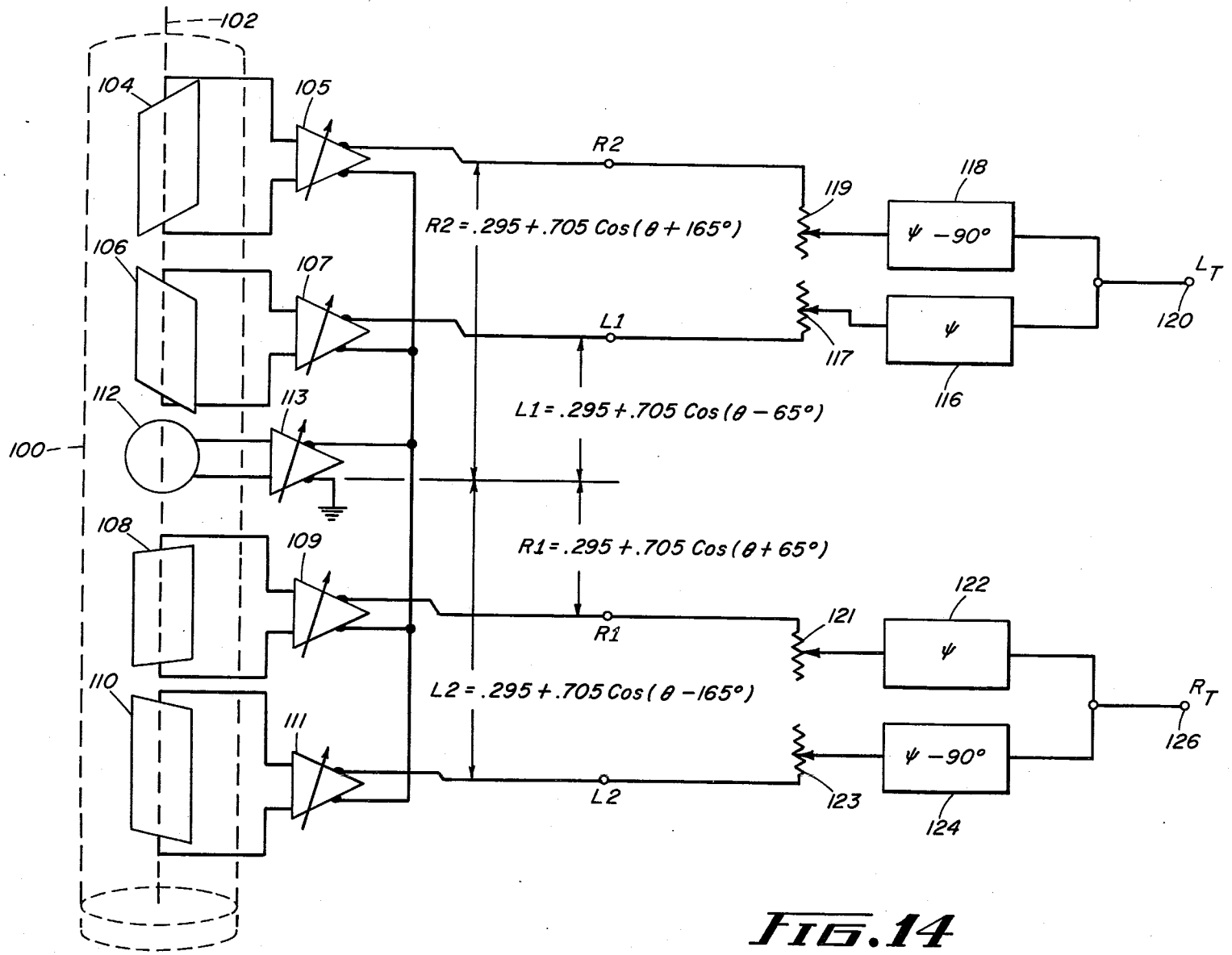
FIG. 14 diagrammatically illustrates a first embodiment of the present invention.

In the embodiment of the invention shown in FIG. 14, an array of four bidirectional microphones 104, 106, 108 and 110 (of the type shown in FIG. 8) and a single omnidirectional microphone 112 (of the type shown in FIG. 5) is supported on a common vertical axis 102 and enclosed in a suitable enclosure 100. The omnidirectional microphone 12 is supported at the midpoint of the array, with two bidirectional microphones above it and two below it; this arrangement places close together those units which work cooperatively so as to minimize phase-shift stemming from the distance between the units in the axial direction. The output leads from microphones 104, 106, 108 and 110 are connected to respective adjustable gain amplifiers 105, 107, 109 and 111, and the output leads from microphone 112 are connected to an adjustable gain amplifier 113. For reasons which will become apparent as the description proceeds, the gains of each of amplifiers 105, 107, 109 and 111 are so adjusted that with the aforementioned sound wave of unity pressure ($p$) impinging thereon the output voltage is normalized at 0.295 volts. Amplifier 113 associated with the omnidirectional microphone is connected in series adding relationship with each of the amplifiers associated with the bidirectional microphones, whereby the output signal from amplifier 113 is added to the output signal from each of the other four amplifiers. Therefore, the basic directional equation of each output signal measured at the output terminals labeled R2, L1, R1 and L2 is $E = 0.295 + 0.705\cos\theta$ as measured from the direction of maximum sensitivity of each output signal. Means other than the amplifiers 105, 107, 109, 111 and 113 may be used to adjust the respective contributions of the microphones.

Figure 15:
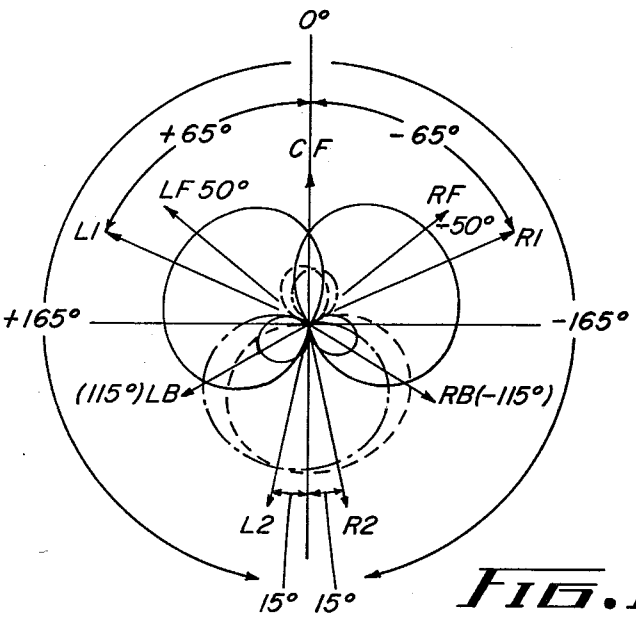
FIG. 15 is a polar plot illustrating the orientation of the bidirectional microphones in the apparatus of FIG. 14.

As indicated in FIG. 14, the four bidirectional microphones are oriented in different directions, their exact relative azimuthal orientation being shown in FIG. 15 by the superposition of the polar sensitivity patterns of the four microphones. Arbitrarily selecting one direction as representing 0° azimuth, the microphone 106 which contributes to the L1 output signal is so oriented that its direction of maximum sensitivity is displaced 65° in the positive (or counterclockwise) direction from 0° azimuth. Microphone 108, which contributes to the R1 output signal, is oriented with its direction of maximum sensitivity displaced negatively, or clockwise, by 65° from 0° azimuth. Microphone 110, which contributes directional information to the L2 output signal, is oriented to have maximum sensitivity in a direction displaced 165° counterclockwise from 0° azimuth, and microphone 104 is oriented to have maximum sensitivity in a direction displaced 165 clockwise from 0° azimuth. Other angles may be used, however, to achieve the final objective hereinafter described.

To derive from the output signals at terminals R2, L1, R1 and L2, a pair of composite signals equivalent to those required by the "SQ" quadraphonic system, the four signals are selectively phase-shifted and combined. More specifically, the L1 output signal is applied to a phase-shift network 116 which is operative to shift the phase by a reference phase shift $\psi$ as a function of frequency, and the $R_1$ output signal is shifted in phase by ($\psi$–90°) in a phase-shift network 118; the phase-shifted signals at the output terminals of networks 116 and 118 are combined to produce at an output terminal 120 a composite signal LT, the characteristic of which will be described presently. Similarly, the R1 output signal is shifted by the reference phase-shift $\psi$ in phase-shifting network 122, the L2 output signal is shifted by ($\psi$–90°) in phase-shifting network 124, and the phase-shifted R1 and L2 signals combined to produce a second composite signal RT at output terminal 126. It should be noted that values of phase differential departing from 90° also may be used, and that prior to the connection to the phase-shift network the relative output signals L1, R1, L2 and R2 may be adjusted by potentiometers 117, 119, 121 and 123, the following analysis of the specific described embodiment being based on the assumption that these contributions are equal. The phase-shift networks are preferably packaged as an integral part of the microphone structure.

The output voltages LT and RT can now be formulated as follows:

$$LT = (L1)+(R2)\,e^{-j90} = L1 - jR2 \quad (1)$$

$$RT = (R1) + (L2)\,e^{-j90} = R1 - jL2 \quad (2)$$

Figure 16:
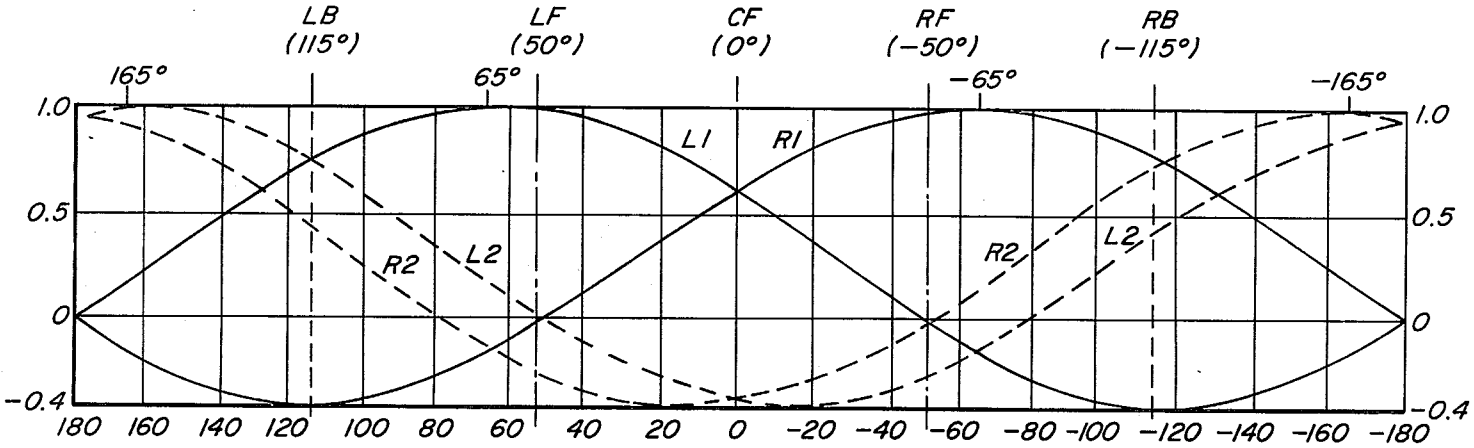
FIG. 16 is a plot of the amplitude as a function of angle of the four signals produced by the microphone array shown in FIG. 14.

The amplitude of the individual components at the output terminals L1, L2, R1 and R2 as a function of azimuthal angle is depicted in FIG. 16, wherein the polar patterns of the four limacon transducers are redrawn in rectangular coordinates. These functions are formulated in terms of the azimuth of sound direction, $\theta$, where $\theta$ is the angle with respect to the axis of maximum sensitivity of each of the limacon-pattern transducers, by the following equations which are normalized to unity:

$$L1 = 0.295 + 0.705\cos(\theta - 65°) \quad (3)$$

$$L2 = 0.295 + 0.705\cos(\theta - 165°) \quad (4)$$

$$R1 = 0.295 + 0.705\cos(\theta + 65°) \quad (5)$$

$$R2 = 0.295 + 0.705\cos(\theta + 165°) \quad (6)$$

In equations (3), (4), (5) and (6), and in the equations follow, L1, L2, R1 and R2 represent the output voltages produced at terminals L1, L2, R1 and R2, respectively, in response to a sound wave of unity pressure (p) impinging thereon.

Inspection of FIG. 16 reveals that the respective coded positions, according to the SQ code, will be formed at the following angles:

LB at 115°; LF at 50°; RF at −50°; and RB at −115°. Calculating LT and RT for these azimuths:

Calculation for LB($\theta$ = 115°)

It will be noted that +115° azimuth is the intersection angle for L1 and L2, both of which, for this angle, provide a relative output of about 0.75. Also, at this angle, R1 and R2 are very nearly equal but of opposite sign. More precisely, as shown by the following equations, the L1 and L2 each provide outputs of 0.748, and R1 and R2 provide relative outputs of −0.410 and +0.417, respectively.

$$L1 = 0.295 + 0.705\cos(115° - 65°) = 0.294 - 0.453 = 0.748 \quad (7)$$

$$L2 = 0.295 + 0.705\cos(115° - 165°) = 0.295 + 0.453 = 0.748 \quad (8)$$

$$R1 = 0.295 + 0.705\cos(115° + 65°) = 0.295 - 0.705 = -0.410 \quad (9)$$

$$R2 = 0.295 + 0.705\cos(115° + 165°) = 0.295 + 0.122 = 0.417 \quad (10)$$

Thus, at 115°, from equations (1) and (2), $$LT = 0.748 - j0.417 \quad (11)$$

$$RT = -0.410 - j0.748 \quad (12)$$

Figure 17:
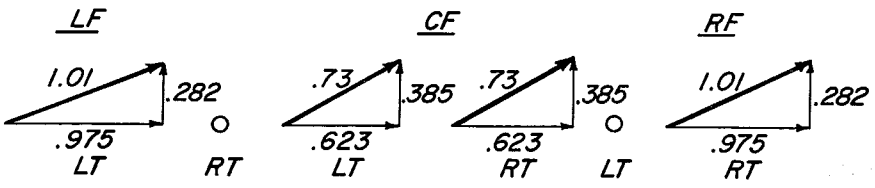
FIG. 17 shows a multiplicity of phasor diagrams used to explain the operation of the system of FIG. 14.
Figure 17:
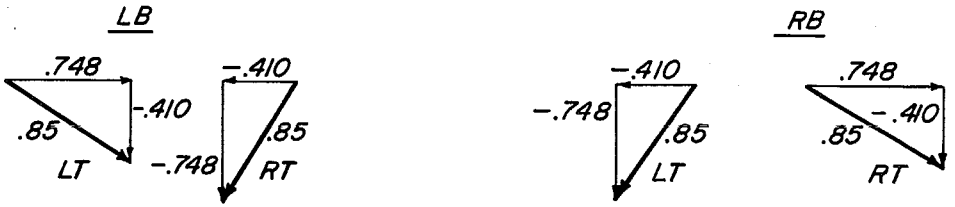

The resultant voltages LT and RT for +115° sound incidence are shown in the lower left part of FIG. 17, from which it is noted that the voltages LT and RT (depicted by the heavy arrows) are equal in amplitude and in quadrature with each other, with RT lagging behind LT. This is the requirement for producing the left-back signal of the "SQ" system of encoding.

Calculation for LF ($\theta$ = 50°)

At the +50° position R1 and L2 cross the zero (0) relative amplitude line; since it is these components (both of which have a value of zero) that produce the RT output (FIG. 14), only an LT output exists. The LT signal consists of two components, L1 having a value of 0.975 (Equation (13)), and a quadrature component R2 having a value of −0.282 (Equation (16)). When the latter is added to the former at 90° lagging phase, as shown in the upper left hand corner of FIG. 17, an LT signal of substantially unity amplitude is produced, corresponding to the left signal of stereo or the left-front signal in the "SQ" system of encoding.

$$L1 = 0.295 + 0.705\cos(50° - 65°) = 0.295 + 0.680 = 0.975 \quad (13)$$

$$L2 = 0.295 + 0.705\cos(50° - 165°) = 0.295 - 0.298 = -0.003 \quad (14)$$

$$R1 = 0.295 + 0.705\cos(50° + 65°) = 0.295 - 0.298 = -0.003 \quad (15)$$

$$R2 = 0.295 + 0.705\cos(50° + 165°) = 0.295 - 0.577 = -0.282 \quad (16)$$

Thus at 50°, from equations (1) and (2), $$LT = 0.975 + j0.282 \quad (17)$$

$$RT = -.003 + j0.003 = 0 \text{ (approximate)} \quad (18)$$

An opposite situation obtains at the −50° angle of sound incidence at which L1 and R2 cross the zero (0) relative amplitude line, thereby producing no LT output, while the R1 and L2 components when combined as shown in FIG. 14 yield an RT signal of substantially unity amplitude, shown in the upper right hand corner of FIG. 17, which corresponds to the right channel of stereo on the right-front signal in the "SQ" system of encoding.

Calculation of RF ($\theta$ = −50°)

$$L1 = 0.295 + 0.705\cos(-50° - 65°) = 0.295 - 0.298 = 0.003 = 0 \text{ (approximate)} \quad (19)$$

$$L2 = 0.295 + 0.705\cos(-50° - 165°) = 0.295 - 0.577 = -0.282 \quad (20)$$

$$R1 = 0.295 + 0.705\cos(-50° + 65°) = 0.295 + 0.680 = 0.975 \quad (21)$$

$$R2 = 0.295 + 0.705 \cos(-50° + 165°) = 0.295 - 0.298 = -0.003 = 0 \text{ (approximate)} \quad (22)$$

Therefore, for $\theta = -50°$, $$LT = -0.003 + j0.003 = 0 \text{ (approximate)} \quad (23)$$

$$RT = 0.975 + j0.282 \quad (24)$$

Calculation for CF ($\theta = 0°$)

Considering now the derived function CF, it will be seen from the following equations and FIG. 16 that for CF at 0° the relative output of L1 and R1 are 0.623 and of L2 and R2 are 0.385, the latter both being negative. Adding the corresponding outputs in their proper quadrature phase relationships (Equations (1) and (2)) produces LT and RT signals having equal relative outputs of 0.73, and which are in-phase with each other, as shown in FIG. 17.

$$L1 = 0.295 + 0.705 \cos - 65° = 0.295 + 0.328 = 0.623 \quad (25)$$

$$L2 = 0.295 + 0.705 \cos - 165° = 0.295 - 0.680 = -0.385 \quad (26)$$

$$R1 = 0.295 + 0.705 \cos 65° = 0.295 + 0.328 = 0.623 \quad (27)$$

$$R2 = 0.295 + 0.705 \cos 165° = 0.295 - 0.680 = -0.385 \quad (28)$$

Thus, at 0°, from equations (1) and (2), $$LT = 0.623 + j0.385 \quad (29)$$

$$RT = 0.623 + j0.385 \quad (30)$$

Calculation of RB ($\theta = -115°$)

It will be seen from FIG. 16 that R1 and R2 intersect at −115°, and that both, for this angle, provide relative outputs of about 0.75. Also, at this angle, L1 and L2 are very nearly equal but of opposite sign. More precisely, as shown by the following equations R1 and R2 each provide relative outputs of 0.748, and L1 and R1 provide relative outputs of −0.410 and +0.417, respectively.

$$L1 = 0.295 + 0.705 \cos(-115° - 65°) = 0.295 - 0.705 = -0.410 \quad (31)$$

$$L2 = 0.295 + 0.705 \cos(-115° - 165°) = 0.295 + 0.122 = 0.417 \quad (32)$$

$$R1 = 0.295 + 0.705 \cos(-115° + 65°) = 0.295 + 0.453 = 0.748 \quad (33)$$

$$R2 = 0.295 + 0.705 \cos(-115° + \ +) = 0.295 + 0.453 = 0.748 \quad (34)$$

Thus, from equations (1) and (2), $$LT = -0.410 - j0.748 \quad (35)$$

$$RT = 0.748 - j0.417 \quad (36)$$

The resultant LT and RT voltages for sound incident at −115° are equal in amplitude and in quadrature with each other, with LT lagging behind RT, equivalent to those required to produce the right-back code of the "SQ" system.

The resultants obtained by the above calculations, for each of the aforementioned five cardinal points, are depicted in FIG. 17 by the heavy arrows. Although the absolute phase relationship of the phasors for LT and RT corresponding to the five cardinal points is displaced from those shown in FIG. 2, the relative phase and amplitude interrelationship of the respective phasors LT and RT are identical in FIG. 17 and in FIG. 2, demonstrating that the apparatus of FIG. 14 is capable of providing encoded signals according to the "SQ" format. In other words, the composite signals produced by the described array of microphones in combination with the circuitry for processing the output signals from the microphones can be decoded with an "SQ" decoder to generate outputs in the quadraphonic listening area which reproduce the directional characteristic of the original sound sources.

The apparatus of FIG. 14 can be modified while preserving the basic principles of the invention. For example, the polar patterns of the four limacon microphones need not be identical, with any discrepancies in the resulting encoded signals corrected by modifying the gain of amplifier 113 so that the omnidirectional microphone makes a different, appropriate contribution of signal to the four bidirectional units. Also, if the microphone array is to be suspended above the surround-sound source field, where the contribution of the gradient microphones would be reduced by the factor cos $\phi$, where $\phi$ is the angle between a horizontal plane through the array and the direction of sound arrival, the gain of amplifier 113 would be decreased by the factor cos $\phi$ to give the appropriate contribution to the outputs of the four bidirectional units to produce the polar patterns shown in FIG. 15. This adjustment may be accomplished by means of an external control knob. Further, although in the described system, output signals having the desired characteristics are obtained by appropriately summing the outputs of omnidirectional and bidirectional microphone elements, microphone elements, such as described in Bauer U.S. Pat. Nos. 2,305,596-599 which produce any desired limacon pattern directly could be used, in which case only four microphone elements would be needed and the intermediate connecting elements between the microphones and the encoder would not be used. Also, the angular differential provided by the phase-shift networks 116, 118, 122 and 124 need not be precisely 90°. The important consideration is that a combination of microphones arranged to produce four limacon-sensitivity patterns which in combination with a relatively simple encoding matrix achieves precise encoding of directional signals in the "SQ" format. Also, the respective contributions of the signals L1 and R1 may differ from those contributed by L2 and R2, which may be achieved, for example, by suitably adjusting the respective potentiometers 117, 119, 121 and 123. As an example, in place of the characteristics described by the equations (3), (4), (5) and (6), the following set may be used:

$$L1 = 0.3 + 0.7 \cos(\theta - 65°) \quad (3')$$

$$L2 = 0.25 + 0.65 \cos(\theta - 165°) \quad (4')$$

$$R1 = 0.3 + 0.7 \cos(\theta + 65°) \quad (5')$$

$$R2 = 0.25 + 0.65 \cos(\theta + 165°) \quad (6')$$

The effective desired polar pattern and the effective angular orientation produced by the apparatus of FIG.

Figure 18:
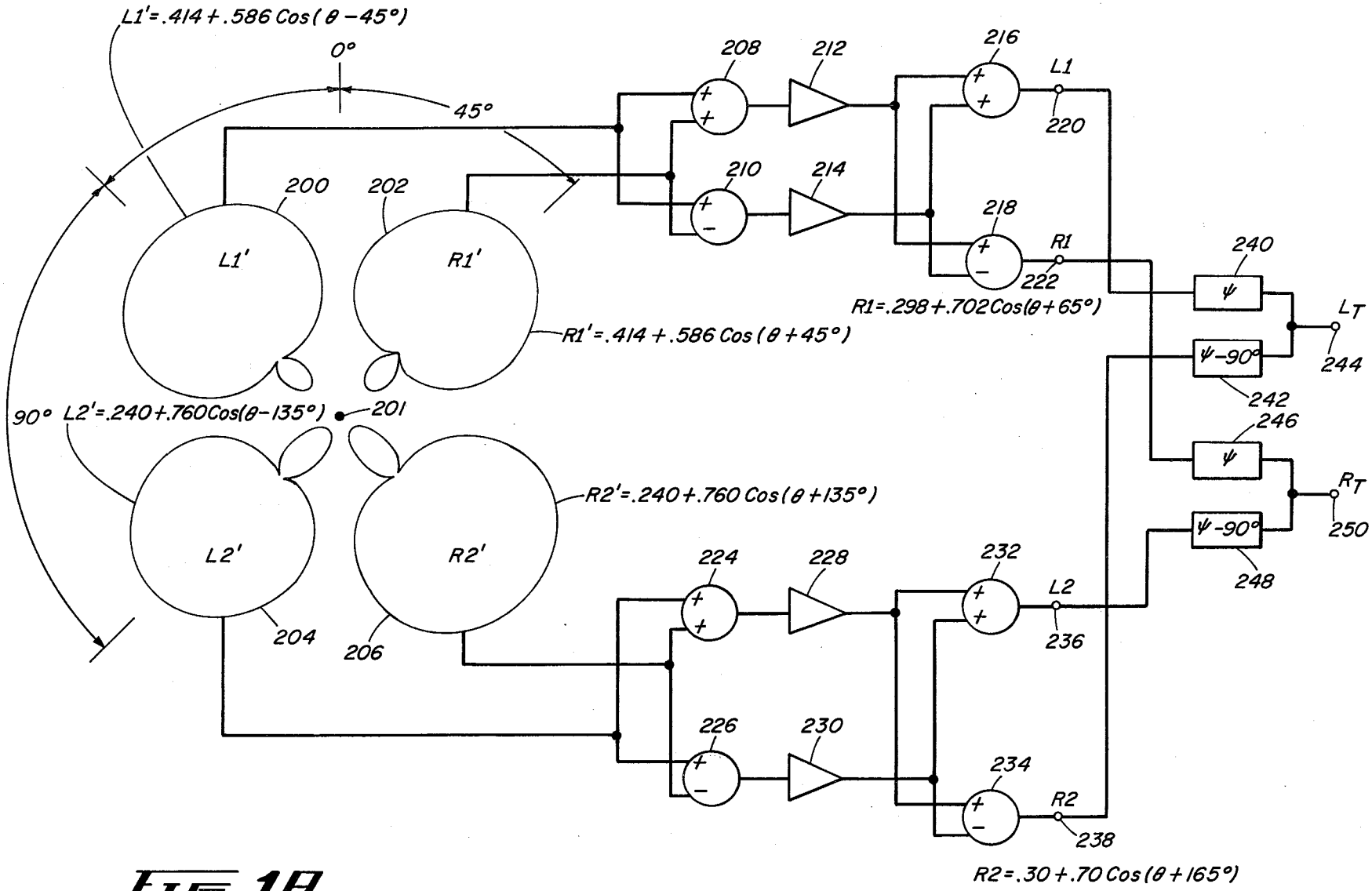
FIG. 18 diagrammatically illustrates a second embodiment of the invention.

14 and illustrated in FIG. 15 can also be obtained with an array of commercially available microphones in which their limacon patterns are angularly displaced at 90° to each other, and obtaining the desired polar patterns by suitably matrixing the output signals from the microphones. As diagrammatically illustrated in FIG. 18, four microphones having limacon sensitivity characteristics are arranged in an array on a common vertical axis and angularly displaced at 90° to each other; that is, the directions of maximum sensitivity of the four microphones are displaced 90° from each other in the horizontal plane. For clarity of representation, the microphone elements are not shown in FIG. 18; instead, their limacon polar patterns 200, 202, 204 and 206, respectively, are shown, and these are shown displaced from the vertical axis 201 to avoid confusion. Selecting 0° azimuth as the "front" of the microphone array, the directions of maximum sensitivity of the patterns 200 and 202 are displaced 45° counterclockwise, respectively, from 0° azimuth. In order to obtain the desired polar patterns and desired orientation after matrixing of the signals produced by the microphones, it is necessary that the microphones themselves have particular polar patterns. More specifically, the patterns for both "front" microphones (patterns 200 and 202) are according to the equation $$E = 0.414 + 0.586 \cos \theta$$

and the patterns for both "back" microphones (patterns 204 and 206) are according to the equation $$E = 0.240 + 0.76 \cos \theta.$$

Limacon patterns having these coefficients are achievable by the internal adjustments provided in commercially available microphones. In order to differentiate the polar patterns of the microphones themselves from the final polar patterns necessary to carry out the purpose of the invention (that is, the equivalent of the patterns of FIG. 15) the microphone patterns 200, 202, 204 and 206 are labeled L1′, R1′, L2′ and R2′, respectively.

Taking into account the orientation of these four patterns, their characteristics are expressed by the following equations:

$$L1' = 0.414 + 0.586 \cos (\theta - 45°) \quad (37)$$

$$L2' = 0.240 + 0.760 \cos (\theta - 135°) \quad (38)$$

$$R1' = 0.414 + 0.586 \cos (\theta + 45°) \quad (39)$$

$$R2' = 0.240 + 0.760 \cos (\theta + 135°) \quad (40)$$

The output signals from the "front" microphones are matrixed by addition in a summing junction 208, and by subtraction of the R1′ output signal from the L1′ signal in a summing junction 210. Expanding the signals L1′ and R1′ by the well-known formula for the cosine of the sum and difference of two angles, the resulting voltage at the output of junction 208 is $0.818 + 0.818 \cos \theta$, and the resulting voltage at the output of junction 210 is $0.818 \sin \theta$. The sum signal from junction 208 is multiplied as by use of an attenuator or a suitable amplifier 212, by a factor of 0.365, and the difference signal from the junction 210 is attenuated or amplified by a suitable amplifier 214 by a factor 0.777. The output signals from the amplifiers 212 and 214 are then again matrixed by addition and subtraction in summing junctions 216 and 218, respectively, to produce at output terminals 220 and 222 a pair of signals L1 and R1, respectively, which will be shown to be the substantial equivalent of the L1 and R1 signals produced by the system of FIG. 14.

When the outputs of junctions 208 and 210 are multiplied by 0.365 and 0.777, respectively, and subsequently matrixed in junctions 216 and 218, the following result is obtained:

$$L1 = 0.298 + 0.298 \cos \theta + 0.635 \sin \theta \quad (41)$$

but, since the last two terms is the expansion for the expression $$0.702 \cos (\theta - 65°),$$

$$L1 = 0.298 + 0.702 \cos (\theta - 65°) \quad (42)$$

Similarly, $$R1 = 0.298 + 0.298 \cos \theta - 0.635 \sin \theta \quad (43)$$

and, as before, $$R1 = 0.298 + 0.702 \cos (\theta + 65°) \quad (44)$$

It is seen that equations (42) and (44) are very nearly the same as equations (3) and (5), respectively, demonstrating the equivalence.

The output signals from "back" microphones 204 and 206 are, similarly, first matrixed by addition and subtraction in summing junctions 224 and 226, respectively. The sum signal from junction 224 is attenuated or amplified by an amplifier 228 which provides a gain of 0.625, and the difference signal is amplified by an amplifier 230 having a gain of 1.67. The output signals from amplifiers 228 and 230 are again matrixed by addition and subtraction in summing junctions 232 and 234, respectively, to produce at output terminals 236 and 238 the signals L2 and R2, respectively, which can be shown by the procedure followed above, to the substantial equivalent of the corresponding signals produced by the system of FIG. 14; that is, $$L2 = 0.3 - 0.675 \cos \theta + 0.181 \sin \theta = 0.3 + 0.7 \cos (\theta - 165°) \quad (45)$$

$$R2 = 0.3 - 0.675 \cos \theta - 0.181 \sin \theta = 0.3 + 0.7 \cos (\theta + 165°) \quad (46)$$

It is seen that equations (45) and (46) are very nearly the same as equations (4) and (6), respectively, demonstrating their substantial equivalence.

Other angular orientation of the limacon microphones can be used with suitable matrixes to achieve the desired overall performance of the microphone system. It will now be evident that once the mathematical theory is developed it is possible to simplify the circuit implementation using conventional design approaches. For example, it is noted that the output voltage delivered by the amplifier 212, which may be said to have a voltage gain $m$, is, $$(L1' + R1')\, m = (L1')\, m + (R1')m \quad (47)$$

while the output voltage delivered by the amplifier 214, which may be said to have a voltage gain of n, is $$(L1' - R1')\, n = (L1')\, n - (R1')\, n \quad (48)$$

The voltage L1 at the output of the junction 216 is obtained by adding equations (47) and (48); thus, $$L1 = L1'(m+n) + R1'(m-n) = (m+n)(L1') + (R1')(m-n)/(m+n) \quad (49)$$

and R1 at the output of junction 218 is obtained by subtracting equation (48) from equation (47), resulting in $$R2 = (L1')(m-n) + (R1')(m+n) = (m+n)((L1')(m-n)/(m+n) + (R1')) \quad (50)$$

Figure 18A:
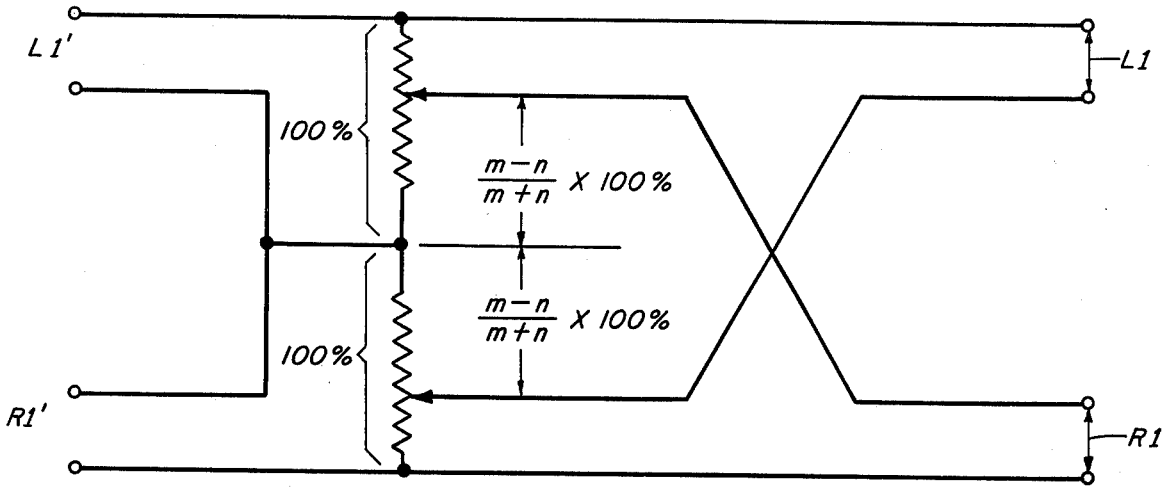
FIG. 18*a* is a schematic diagram of an alternate form of signal matrixing circuit useful in the system of FIG. 18.

Thus, the matrixing operation can be carried out with the simplified circuit shown in FIG. 18*a*, producing a result equivalent to that yielded by the outputs L1 and R1, except for the factor $(m+n)$ which can readily be taken care of elsewhere in the circuit. Similar simplification may be used in connection with the outputs of the microphones L2′ and R2′.

Another simplifying arrangement, in the case when the microphones L1′ and R1′ are mounted on a common support, consists in shifting both to produce the desired front angles of ±65°, and matrixing, only the output signals from microphones L2′ and R2′ to provide the desired effective orientation for L2 and R2.

As in the case of FIG. 14 embodiment, to produce the desired quadraphonic encoding of the sound signals surrounding the microphone array, the L1 signal after being shifted in phase by a reference angle $\psi$ in a phase-shift network 240 is combined with the R2 signal after being phase-shifted by $(\psi-90°)$ in a phase-shift network 242 to produce the composite signal LT at output terminal 244. Similarly, the R1 signal is phase shifted by the reference angle $\psi$ by a phase-shift network 246 and then combined with the L2 signal after being shifted in phase by $(\psi-90°)$ by a phase-shift network 248 to produce the composite signal LT at output terminal 244. It will be evident from the calculations in connection with the system of FIG. 14, that the composite signals LT and RT are essentially the same as those produced by the FIG. 14 system; that is, signals encoded in the "SQ" format which can be decoded with an "SQ" decoder to generate outputs in the listening area which reproduce the directional characteristics of the original sound sources.

I claim:

1. Apparatus for producing first and second composite signals the first of which comprises the sum of a predominant left-front (LF) signal component and subdominant left-back (LB) and right-back (RB) signal components and the second of which comprises the sum of a predominant right-front (RF) signal component amd said subdominant LB and RB components and in which the LB and RB signal components in one of said channels lead and lag, respectively, the LB and RB signal components in the other of said channels by a predetermined differential phase-shift angle, said apparatus comprising:

means including an array of at least four microphones in close proximity to each other for producing, when disposed within a field of surround-sound sources of sound, four signals each defined by a predetermined limacon sensitivity pattern having the equation $E = + (1-k)\cos\theta$ whose directions of maximum sensitivity are oriented at different predetermined azimuthal angles relative to a reference direction, wherein $k$ is a constant having a value less than one, $\theta$ is the angle between said reference direction and the axis of maximum sensitivity of each microphone, and E is the normalized amplitude of the voltage produced by an incident sound wave of unity pressure, means for shifting the phase of a first of said four signals relative to a second of said four signals by a predetermined phase angle and combining said phase-shifted first and second signals to produce said first composite signal, and means for shifting the phase of a third of said four signals relative to the fourth of said four signals by a predetermined phase angle and combining said phase-shifted third and fourth signals to produce said second composite signal.

2. Apparatus according to claim 1, wherein said predetermined phase angle is about 90°.

3. Apparatus according to claim 1, wherein the first and the second of said four signals define limacon sensitivity patterns whose directions of maximum sensitivity are oriented at about −65° and +65°, respectively, from said reference direction, and wherein the third and fourth of said four signals define limacon sensitivity patterns whose directions of maximum sensitivity are oriented at about −165° and +165°, respectively, from said reference direction.

4. Apparatus according to claim 3, wherein $k$ has a value of about 0.295.

5. Apparatus according to claim 1, wherein said array consists of first, second, third and fourth directional microphones each having a predetermined limacon sensitivity pattern having the equation $E = k + (1-k)\cos\theta$ and whose directions of maximum sensitivity are at different predetermined angles relative to said reference direction, and wherein said first-mentioned means further includes circuit means for matrixing the output signals produced by said first, second, third and fourth microphones to produce said four signals.

6. Apparatus according to claim 5, wherein said first, second, third and fourth microphones are disposed with their directions of maximum sensitivity displaced by about 90° from each other, and wherein the maximum sensitivity directions of said first and second microphones are displaced by about 45° clockwise and counterclockwise, respectively, from said reference direction.

7. Apparatus according to claim 6, wherein said first and second microphones each have limacon sensitivity patterns wherein $k$ has a value of about 0.414 and said third and fourth microphones each have limacon sensitivity patterns wherein k has a value of about 0.240.

8. Apparatus according to claim 1, wherein said array consists of first, second, third and fourth directional microphones and an omnidirectional microphone in close proximity with said directional microphones, and wherein said first-mentioned means includes circuit means for adding a predetermined fraction of the output signal from said omnidirectional microphone to a predetermined fraction of the output signals from each of said first, second, third and fourth directional microphones to produce said four signals.

9. Apparatus according to claim 8, wherein said first, second, third and fourth directional microphones are so oriented relative to said reference direction and said predetermined fractions have such values that the first and the second of said four signals define limacon sensitivity patterns wherein $k$ has a value of about 0.295 and whose directions of maximum sensitivity are oriented at about $-65°$ and $+65°$, respectively, from said reference direction, and the third and the fourth of said four signals define limacon sensitivity patterns wherein $k$ has a value of about 0.295 and whose directions of maximum sensitivity are oriented at about $-165°$ and $+165°$, respectively, from said reference direction.

10. An array of at least four microphones supported in close proximity with each other and each operative to produce when disposed within a field of surround-sound sources an electrical signal defined by a predetermined limacon sensitivity pattern the directions of maximum sensitivity of said at least four microphones being oriented at different predetermined angles relative to a 0° reference direction, a first and a second of said signals defining patterns of substantially similar shape whose directions of maximum sensitivity are oriented at about $-65°$ and $+65°$, respectively, from said reference direction, and a third and a fourth of said signals defining patterns of substantially similar shape whose directions of maximum sensitivity are oriented at about $-165°$ and $+165°$, respectively, from said reference direction.

* * * * *